United States Patent [19]

Lissenburg et al.

[11] Patent Number: 4,810,915

[45] Date of Patent: Mar. 7, 1989

[54] MOTOR-COMPRESSOR

[75] Inventors: Rokus C. D. Lissenburg; Paulus J. M. Verboven, both of Eindhoven, Netherlands

[73] Assignee: U.S. Philips Corporation, New York, N.Y.

[21] Appl. No.: 114,796

[22] Filed: Oct. 29, 1987

[30] Foreign Application Priority Data

Oct. 29, 1986 [NL] Netherlands ..... 8602720

[51] Int. Cl.[4] ..... H02K 33/12

[52] U.S. Cl. ..... 310/37; 310/51; 310/80; 318/114

[58] Field of Search ..... 310/36, 37, 51, 80, 310/81; 417/363, 417; 415/119; 318/114

[56] References Cited

U.S. PATENT DOCUMENTS 2,934,297 4/1960 Mitzl ..... 310/51 X
3,546,503 12/1970 Richardson ..... 310/51

FOREIGN PATENT DOCUMENTS 1124181 2/1962 Fed. Rep. of Germany ..... 310/51
284121 4/1931 Italy ..... 310/38
0086577 5/1982 Japan ..... 417/363

*Primary Examiner*—Patrick R. Salce
*Assistant Examiner*—Judson H. Jones
*Attorney, Agent, or Firm*—F. Brice Faller

[57] ABSTRACT

A motor-compressor comprising a vibration motor (1) having a rotationally vibrating drive shaft (4) and a compressor (2) having at least one piston (10) which is linearly reciprocated by the motor shaft (4) is suspended in the housing (14) by means of springs (15) so that the points of attachment (17) of the springs are coplanar with and as close as possible to the axis (16) of the rotation, to which the motor- compressor is subjected in operation. This counteracts the imbalance forces to a maximum extent and minimizes the dynamic forces on the housing.

4 Claims, 2 Drawing Sheets

MOTOR-COMPRESSOR

BACKGROUND OF THE INVENTION

The invention relates to a motor-compressor comprising a vibration motor having a rotationally vibrating drive shaft and a compressor having at least one piston which is linearly reciprocated by the motor shaft, which motor-compressor is accomodated in a housing.

Such a motor-compressor is known from EP-A-O, No. 155,057. In the motor-compressor described therein the rotationaly vibrating motion of the rotor is converted into a linearly reciprocating motion of the pistons by means of a transmission. The moving parts in conjunction with the forces exerted by the electric motor and the gas forces constitute a mass-spring system. The motor is powered with a frequency equal to the natural frequency of the mass-spring system. When rigidly suspended this motor-compressor exhibits a substantial imbalance caused by the mass inertia of the moving parts and by the non-centric arrangement of the cylinder relative to the rotor bearing. The nature of the imbalance is such that the use of eccentric weights to compensate does not provide a satisfactory solution.

SUMMARY OF THE INVENTION

It is the object of the invention to compensate for the imbalance in such a way that the forces exerted on the compressor housing are minimized.

To this end the motor-compressor is suspended in the housing by means of springs in such a way that the points of attachment of these springs in the housing are disposed in a plane which also contains the axis of the rotation to which the motor-compressor is subjected in operation, and in that the springs are situated as close as possible to the axis of rotation.

The points of attachment are selected so as to permit movement (vibration) of the motor-compressor. The rotational vibration is performed about an axis of rotation. By selecting the location of the points of attachment and the stiffness of the springs so as to obtain a low-frequency mass-spring system and such that the system vibrates overcritically about the axis of rotation with a motion which is out of phase with the motion of the rotor/piston, the unbalance forces are counteracted to a maximum extent by the acceleration forces caused by the movement of the static part (motor stator+cylinder) of the motor-compressor. This minimizes the movement of the points of attachment and hence the dynamic forces acting on the points of attachment.

DETAILED DESCRIPTION OF THE PREFERRED EMBODIMENTS

Figure 1:
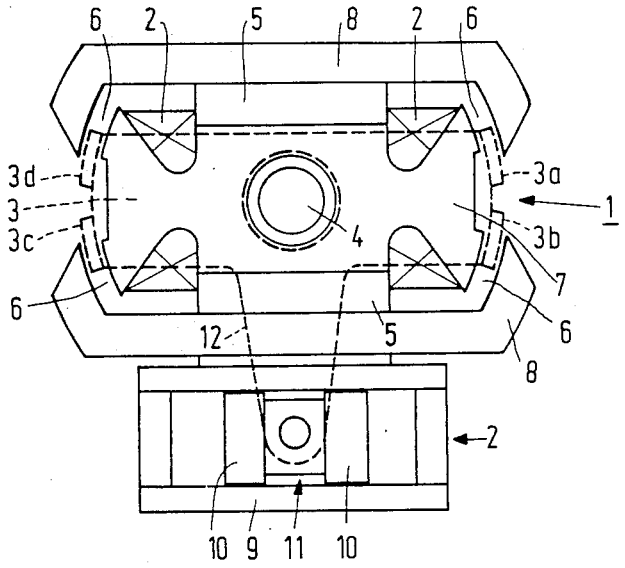
FIG. 1 diagrammatically shows a motor-compressor comprising a rotationally vibrating rotor and linearly recriprocating pistons, to which the invention is applied.

The operation of the motor-compressor is described in EP-A-O, No. 155,057. Briefly, it operates as follows: An alternating current through the coils 2 of the vibration motor 1 results in a rotationally vibrating motion of the rotor 3 about the axis 4. For each rotor section (*3a, 3b, 3c, 3d*), which is constructed as a sliding element the alternating magnetic field generated by the coils is superimposed on the magnetic field produced by the permanent magnet 5. As a result of this the magnetic flux density in each rotor section alternately assumes a large and a small value. The coils are wound in such a way relative to the direction of magnetization of the permanent magnets that at the same instant two diagonally opposed rotor sections (*3a, 3c*) experience a high magnetic flux density, whilst the other two rotor sections (*3b, 3d*) experience a low flux density. This causes a movement of the rotor sections in the air gaps 6 between the core 7 and the stator plates 8, where a high flux density exists. A change in current direction will cause the movement of the rotor 3 to be reversed, thus yielding a vibrating movement of the rotor. The compressor 2 comprises a cylinder 9 in which two pistions 10 can linearly reciprocate. The pistons are coupled to an arm 12 of the vibrating rotor 3 by means of a transmission mechanism 11. This results in a mass-spring system whose resonant frequency is dictated by the gas forces acting on the pistons, the electromagnetic forces acting on the rotor, and the mass inertia of the moving parts. For an efficient operation of the motor the frequency of the alternating current in the coils is selected to equal the resonant frequency of the mass-spring system.

Figure 2:
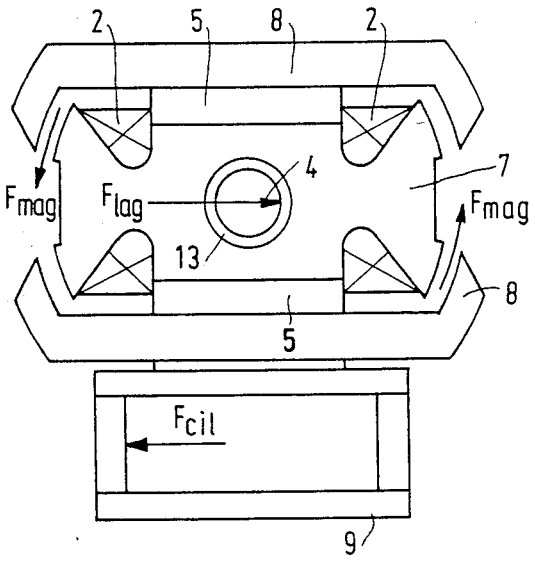
FIG. 2 shows the non-moving part of the motor-compressor of FIG. 1, i.e. without rotor and pistons, and the forces acting in this part.

FIG. 2 illustrates the system of forces acting on the non-moving part, i.e. on the cylinders 9 and the static parts (2, 5, 7, 8) of the motor-compressor. In this Figure $F_{cil}$ is the force acting on the cylinder as a result of the gas forces and piston friction, $F_{lag}$ is the force on the bearing 13 of the rotor shaft 4 as a result of the forces on the piston 10 and on the rotor 3 and the mass inertia of the moving parts, and $F_{mag}$ are the magnetic forces between the rotor sections (*3a, 3b, 3c, 3d*) and the core-stator parts.

The imbalance has three components:

The mass inertia of the moving parts; these exert a reactive force in the horizontal direction of the bearing 13.

The forces on the pistons; these act on the cylinder and a reactive force in the bearing 13; owing to the non-centric arrangement of the cylinder 9 relative to the bearing 13 of the rotor shaft these forces exert a torque on the non-moving part (2, 5, 7, 8, 9) of the motor-compressor.

The magnetic forces on the stator plates 8 and the core 7; these forces also exert a torque on the non-moving part. Computations show that the magnetic forces are small relative to the gas forces. In the extreme positions of the rotor sections the gas forces are maximal and the direction of movement is reversed. In this situation the forces acting on the non-moving part are not balanced, which gives rise to forces acting on the points of attachment.

Figure 3A:
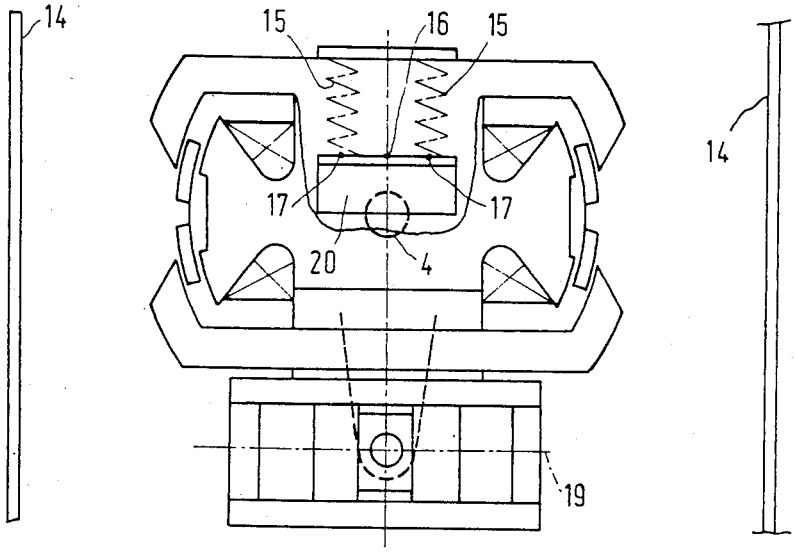
FIG. 3A is a diagrammatic front view and FIG. 3B is a diagrammatic side view of the motor-compressor resiliently suspended in the housing.
Figure 3B:
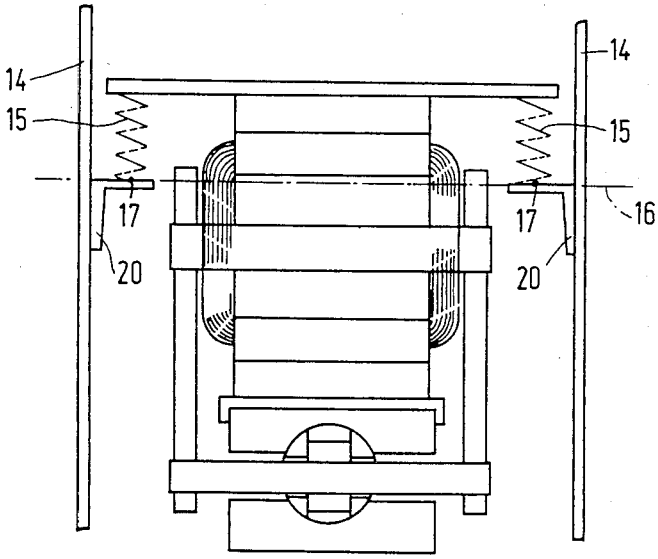

FIG. 3 shows the motor-compressor suspended in hermetically sealed housing 14 by means of coil springs 15 so as to permit movement of the non-moving part (2, 5, 7, 8, 9) of the motor-compressor. The stiffness of the springs is such that a low-frequency mass-spring system is obtained, causing the system to vibrate overcritically about an axis of rotation 16. By locating the points of attachment 17 of the springs 15 to the housing 14 in the same plane as that the axis of rotation 16 of the motor-compressor, and by situating the springs 15 as close as possible to axis 1b, the motor-compressor will perform a vibrational rotation which is out of phase with the motion of the rotor 3/pistons 9 The acceleration forces caused by the movement of the stationary part (2, 5, 7, 8, 9) of the motor-compressor thus counteract the imbalance forces to a maximum extent. The springs must be compliant in a lateral direction, i.e. perpendicular to the axis of rotation, and consequently be capable of taking up minimal forces. This minimizes the dynamic forces exerted on the points of attachment 17.

The location of the axis of rotation 16 can be calculated on the basis of the forces which occur, namely in such a way that the resulting forces acting on the housing, i.e. on the points of attachment 17, are minimal.

The motor-compressor shown in the Figures is constructed symmetrically about the line 18 which extends perpendicularly to the axis of rotation 16. The axis of rotation 16 intersects the piston axes 19 perpendicularly and extends parallel to the rotor shaft 4. In operation the average gas forces acting on the piston/cylinder 9, 10 at the left and the right are equal. Therefore, during the vibrational rotation of the motor-compressor the angular rotation relative to the plane containing the axis of rotation 16 and the line 18 will also be symmetrical. In the present example the suspension selected for the motor-compressor utilizes four helical springs 15, i.e. two parallel springs on each side of the motor-compressor, which are each situated symmetrically relative to and close to the axis of rotation 16. The springs are supported in the compressor housing 14 by means of corner supports 20. The other end of each spring is secured to a rigid plate 21, which is secured to the upper stator plate 8.

What is claimed is:

1. A motor-compressor comprising a housing, a vibration motor having a rotationally oscillating drive shaft, a compressor having at least one piston which is linearly reciprocated by the drive shaft, springs which support said motor in said housing, said motor rotating about an axis of rotation, said springs being attached to said housing at points which are at least substantially coplanar with said axis of rotation.

2. A motor-compressor as claimed in claim 1, characterized in that the axis of rotation extends parallel to the drive shaft.

3. The motor-compressor as claimed in claim 2, characterized in that the compressor comprises two coupled pistons.

4. A motor-compressor as claimed in claim 1 characterized in that the springs are coil springs.

* * * * *